US005806842A

United States Patent [19]

Steinhilber et al.

[11] Patent Number: 5,806,842

[45] Date of Patent: Sep. 15, 1998

[54] OUTPUT PAPER SHEET FINISHING MODULE AND METHOD OF USING SAME

[75] Inventors: Friedhelm W. Steinhilber; Klause B. Bergander, both of Rottweil, Germany

[73] Assignee: BDT Products, Inc., Irvine, Calif.

[21] Appl. No.: 748,507

[22] Filed: Nov. 8, 1996

[30] Foreign Application Priority Data

Jun. 28, 1996 [DE] Germany ..... 196 25 994.0
Jul. 19, 1996 [DE] Germany ..... 196 29 158.5

[51] Int. Cl.[6] ..... B41J 15/04

[52] U.S. Cl. ..... 270/58.08; 270/58.18

[58] Field of Search ..... 270/58.08, 58.01, 270/58.14, 58.18, 58.19

[56] References Cited

U.S. PATENT DOCUMENTS

D. 246,459 11/1977 Olson .
D. 275,762 10/1984 Olson .
D. 275,764 10/1984 Olson .
D. 344,973 3/1994 Penke et al. .
D. 369,381 4/1996 Gotham et al. .
T958,003 5/1977 Russel et al. .
4,058,196 11/1977 Rempel ..... 197/133 R
4,134,672 1/1979 Burlew et al. .
4,248,525 2/1981 Sterrett .
4,343,673 8/1982 Smith, Jr. et al. .
4,398,986 8/1983 Smith, Jr. et al. .
4,417,801 11/1983 Eisemann .
4,424,963 1/1984 Bartholet et al. .
4,438,918 3/1984 Ito et al. .
4,564,185 1/1986 Hamlin et al. .
4,602,775 7/1986 Calhoun et al. .
4,603,971 8/1986 Kukucka et al. .
4,626,156 12/1986 Baughman .
4,671,686 6/1987 Howes et al. ..... 400/605
4,878,656 11/1989 Honjo et al. .
4,903,952 2/1990 Russel et al. .
4,925,172 5/1990 Christy et al. .
4,965,629 10/1990 Hiroi et al. .
4,988,029 1/1991 Fiske .
5,008,709 4/1991 Shinada et al. .
5,013,021 5/1991 Johdai et al. .
5,020,785 6/1991 Kosaka et al. .
5,032,876 7/1991 Murakami .
5,045,881 9/1991 Kinder et al. .
5,053,831 10/1991 Ishiguro et al. .
5,056,774 10/1991 Kubota et al. .
5,072,920 12/1991 Kubota et al. .
5,080,340 1/1992 Hacknauer et al. .
5,080,342 1/1992 Mori et al. .
5,080,348 1/1992 Pendell et al. .
5,083,760 1/1992 Yamazaki et al. .
5,087,979 2/1992 Schaertel .
5,094,379 3/1992 Hoyer et al. .
5,095,369 3/1992 Ortiz et al. .
5,099,292 3/1992 Hirose .
5,101,240 3/1992 Pendell et al. .
5,108,081 4/1992 Russel et al. .
5,108,082 4/1992 Shea et al. .
5,121,911 6/1992 Yamazaki et al. .
5,129,640 7/1992 Kosaka et al. .
5,131,641 7/1992 Hidaka .
5,133,539 7/1992 Ishiguro et al. .
5,137,266 8/1992 Mori et al. .
5,137,270 8/1992 Sloan et al. .
5,141,215 8/1992 Ishiguro et al. .
5,184,185 2/1993 Rasmussen et al. .
5,192,065 3/1993 Hirota et al. .
5,229,812 7/1993 Toyama et al. .
5,236,189 8/1993 Ikoma .
5,253,860 10/1993 Hirose et al. .
5,263,697 11/1993 Yamazaki et al. .

(List continued on next page.)

*Primary Examiner*—David A. Okonsky
*Attorney, Agent, or Firm*—Higgs, Fletcher & Mack LLP; Bernard L. Kleinke

[57] ABSTRACT

An output document finishing module and a method of using it, relate to a document finishing module which is removably mounted to a paper sheet receiver for a non-impact printer. The module receives the printed sheets from the non-impact printer and finishes them by stapling or hole punching. The module can be removed from the receiver and replaced with conventional document receiving bins.

21 Claims, 15 Drawing Sheets

U.S. PATENT DOCUMENTS 5,263,708 11/1993 Hacknauer .
5,265,855 11/1993 Kimura et al. .
5,279,494 1/1994 Kitajima et al. .
5,297,376 3/1994 Taguchi et al. .
5,326,093 7/1994 Sollitt ..... 271/306
5,330,170 7/1994 Yotani et al. .
5,377,965 1/1995 Mandel et al. .
5,382,011 1/1995 Tani .
5,431,388 7/1995 Bridoux .
5,442,432 8/1995 Tani .
5,447,298 9/1995 Watanabe et al. .
5,467,627 11/1995 Smith et al. .
5,508,798 4/1996 Yamada .
5,524,873 6/1996 Hosoi et al. .
5,542,655 8/1996 Murakami .
5,551,681 9/1996 Ferrara .
5,556,251 9/1996 Hiroi et al. .
5,590,871 1/1997 Okabe et al. .
5,599,008 2/1997 Yamashita et al. .
5,630,578 5/1997 Naramore et al. ..... 270/58.08

OUTPUT PAPER SHEET FINISHING MODULE AND METHOD OF USING SAME

CROSS-REFERENCE TO RELATED APPLICATIONS

This application relies on the priority patent application of Federal Republic of Germany patent application serial No. 19625994.0, entitled "Vorrichtung zum ausgerichteten Ablegen von Blättern," and assigned to BDT BüBuro-und Datentechnik GmbH & Co. by Klaus Bergander; and also patent application of Federal Republic of Germany patent application serial No. 19629158.5, entitled "Vorrichtung zum gestapelten Ablegen von Blattern," and assigned to BDT Buro-und Datentechnik GmbH & Co. by Klaus Bergander; both of said patent applications being incorporated by reference as if fully set forth herein.

TECHNICAL FIELD

The present invention relates in general to a modular output paper sheet finishing module and a method of using it in connection with a non-impact printer, such as a laser printer or an ink jet printer. The invention more particularly relates to an output document finishing module used to finish, such as staple or hole punch, the printed sheets being ejected from the printer.

BACKGROUND ART

Modern high-speed non-impact printers, such as laser printers and ink jet printers are typically equipped with sheet paper receivers, such as sorters or mailboxes, to receive paper sheets or sets of paper sheets to form assembled documents. The receivers employ a series of output bins or stacking trays mounted to the printer in a vertically spaced-apart manner. A paper sheet transport moves the printed paper sheet to the individual output stacking trays selectively.

Reference may be made to pending U.S. patent application filed Oct. 16, 1996, entitled "APPARATUS FOR EJECTING PAPER SHEETS INTO STACKING TRAYS." The subject copending patent application is hereby incorporated by reference.

As the paper sheets are delivered to the receiver at high rates of speed, it is frequently desirable to have the paper sheets assembled into documents within the stacking trays. In this manner, they can be readily removed manually and the documents can then be finished. In this regard, the finishing process can include affixing them together by a suitable technique, such as stapling. Also, the document may require hole punching. However, these added steps are time consuming, and therefore increase the overall processing time for the documents. Therefore, it would be highly desirable to have a technique for decreasing the document processing time in connection with documents being printed by a non-impact printer.

In addition to the unwanted delays associated with the finishing processes, it would be highly desirable to have a new and improved high-speed processing system which includes the finishing steps in a highly automated and efficient manner. Furthermore, such a system should be readily adaptable to accommodate different non-impact printers.

SUMMARY OF THE INVENTION

Therefore, it is the principal object of the present invention to provide a new and improved output document finishing module and method of using it, whereby documents can be readily and conveniently finished at a high rate of speed as they are being discharged from a non-impact printer.

Another object of the present invention is to provide such a new and improved document finishing module and method of using it, whereby the module is used as part of a system which can accommodate various different non-impact printers.

Briefly, the above objects and features of the present invention are realized by providing a new and improved output document finishing module and method of using it, whereby the module is removably attachable to a document receiver for a non-impact printer. The module and the receiver are so constructed and arranged that they are able to cooperate with various different non-impact printers.

An output document finishing module and a method of using it, relate to a document finishing module which is removably mounted to a paper sheet receiver for a non-impact printer. The module receives the printed sheets from the non-impact printer and finishes them by stapling or hole punching. The module can be removed from the receiver and replaced with conventional document receiving bins.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
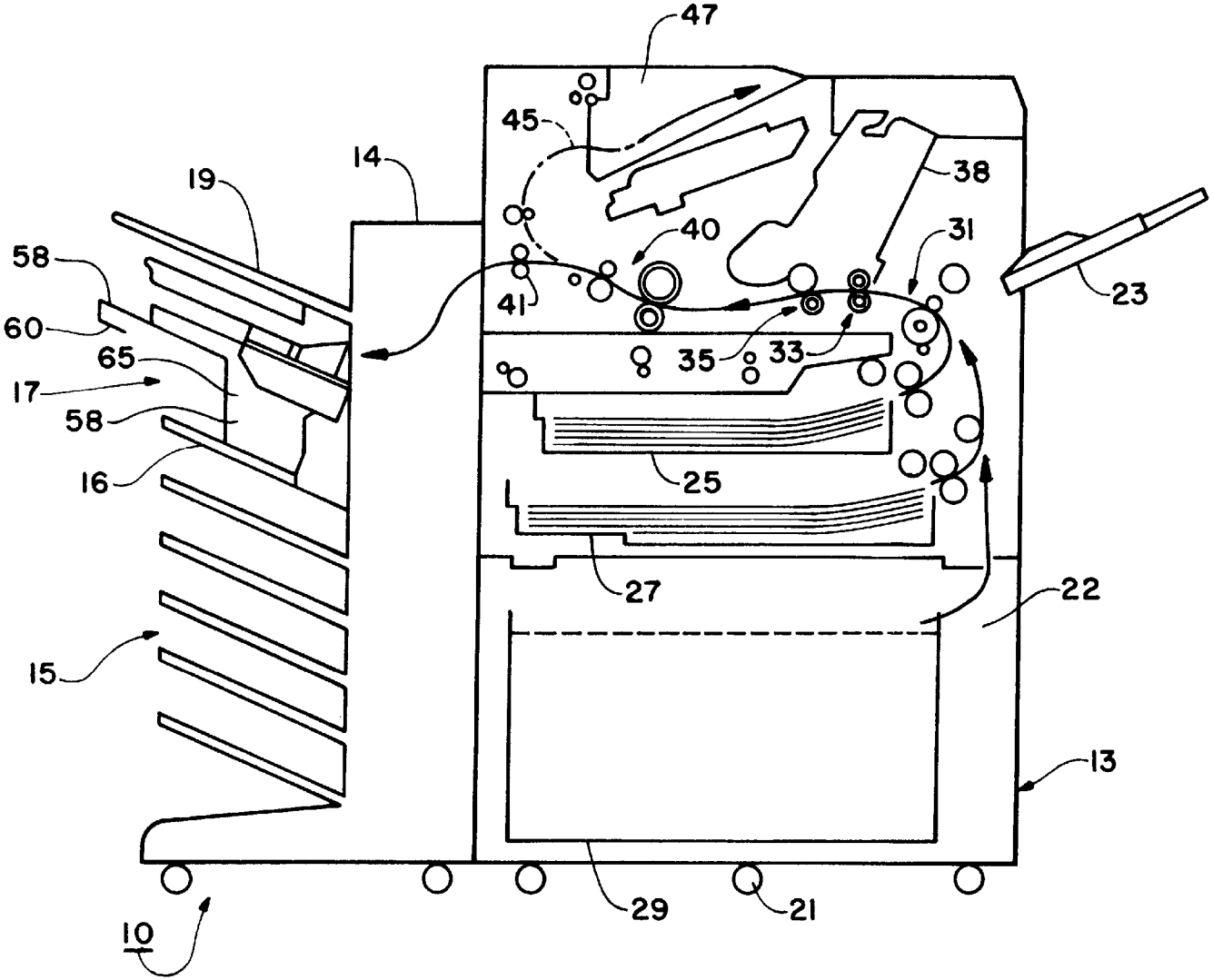
FIG. 1 is a diagrammatic view of a modular printing system, which is constructed in accordance with the present invention.

Referring now to the drawings, and more particularly to FIGS. 1, 2, 2A and 2B, there is shown a printing system 10 which includes a non-impact printer 13, such as a laser printer or an inkjet printer. The printer 13 may be a conventional Hewlett Packard Laserjet V Si. A paper sheet receiver 14 is mounted to the printer 13 and has a series of vertically spaced apart paper stacking tray generally indicated at 15 for receiving the printed paper sheets from the printer 13. The receiver 14 may be a mailbox or a sorter. In the preferred form of the invention, the receiver is a mailbox, and is disclosed in greater detail in co-pending U.S. patent application, entitled "APPARATUS FOR EJECTING PAPER SHEETS INTO STACKING TRAYS," filed Oct. 16, 1996, which application is incorporated herein by reference as if fully set forth herewithin.

Figure 2:
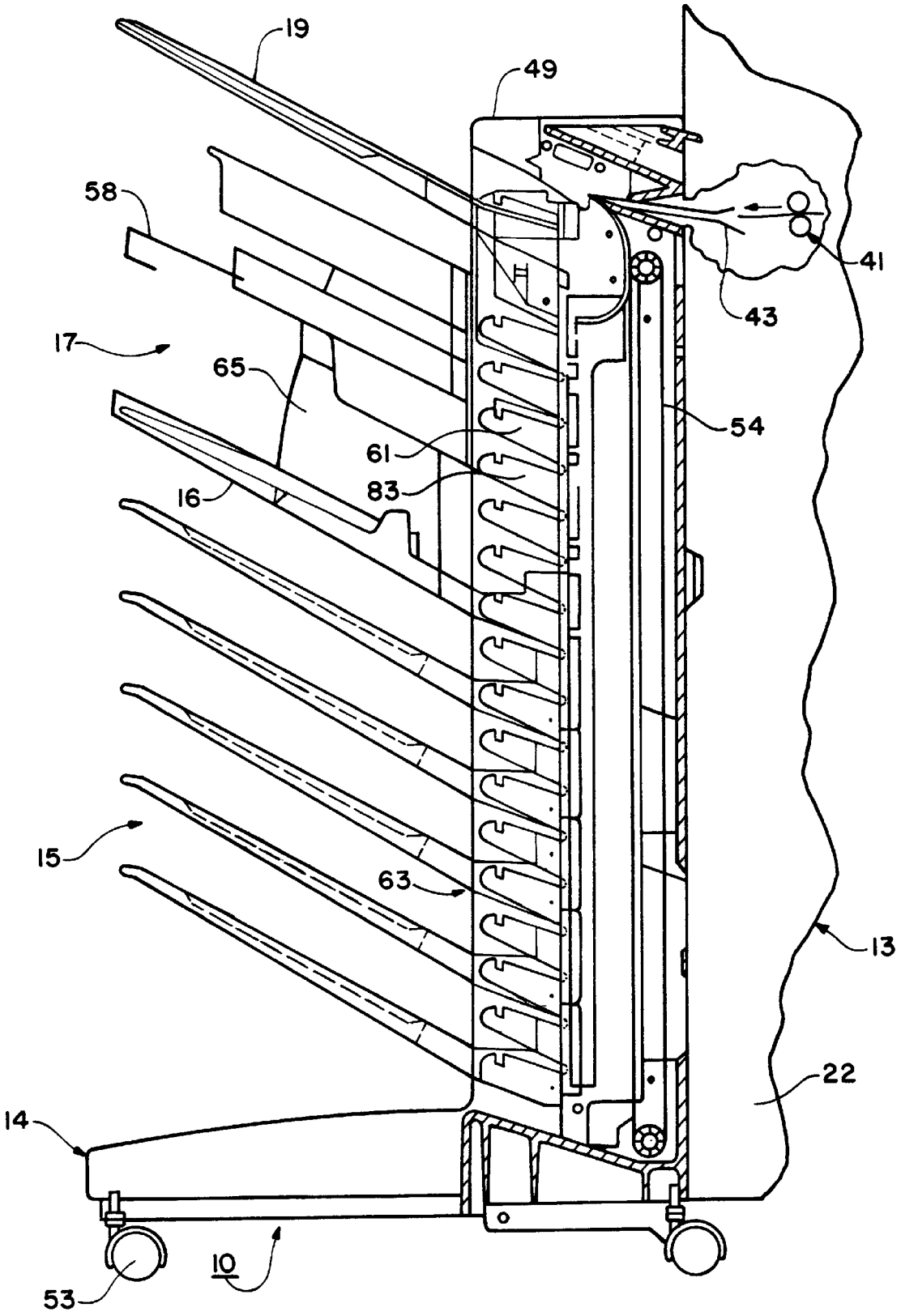
FIG. 2 is an enlarged fragmentary view of the system of FIG. 1, illustrating a left side elevational fragmentary view and partial section.

As best seen in FIGS. 1 and 2, an output finishing module 17 is mounted to the receiver 14 at the upper portion thereof below a face up stacking tray 19 for stapling and hole punching the printed paper sheets for finishing purposes. In accordance with the present invention, the module 17 can be detached from the receiver 14, and replaced with additional stacking trays, such as the stacking trays 15. In this manner, the overall system 10 is highly flexible and modular in design. The finishing module 17 enables the printed sheets received from the printer 13 to be finished at a high rate of speed as they are ejected from the printer 13 and enter the receiver 14 as hereinafter described in greater detail.

Considering now the printer 13 in greater detail with reference to FIG. 1, the printer 13 includes a housing 22 which is rollably mounted on the floor by casters, such as the caster 21. A multi-purpose paper supply tray 23 and a set of three special purpose paper supply trays, 25, 27 and 29 supply paper sheets along a paper feed path generally indicated at 31 through pairs of feed rollers 33 and 35 past a toner cartridge at 38. The printed paper sheets are fed through-a set of feed rollers generally indicated at 40 up to a pair of output feed rollers 41 to a receiver input throat 43 (FIG. 2) for introducing the printed paper sheets into the receiver 14. An alternate output portion of the paper feed path indicated in broken lines generally at 45 can direct the paper sheets into a primary output bin 47 in place of directing the printed sheets into the receiver 14 as an optional mode of operation of the system 10.

Figure 2A:
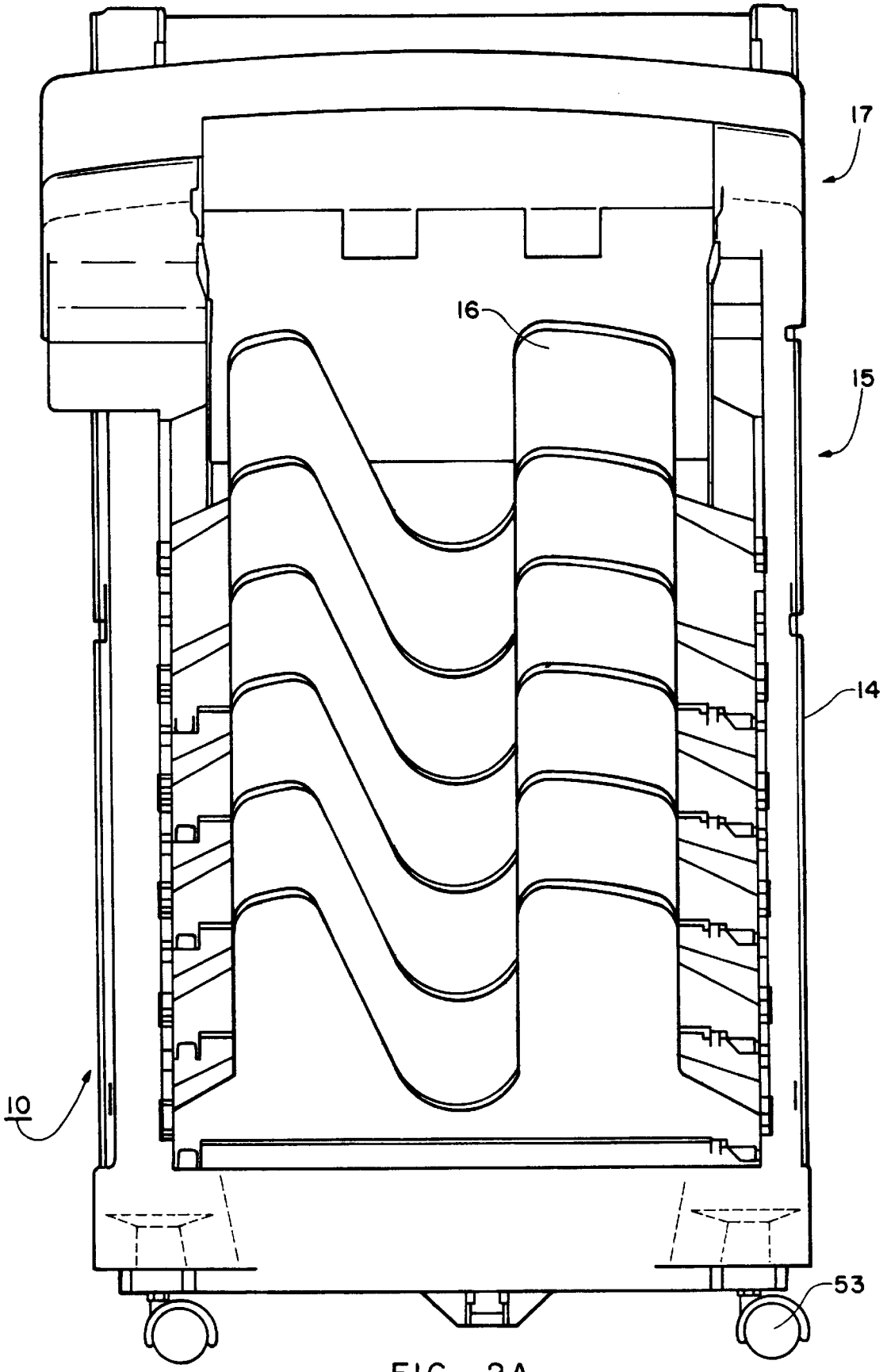
FIG. 2A is a front elevational view of the system of FIG. 2.
Figure 2B:
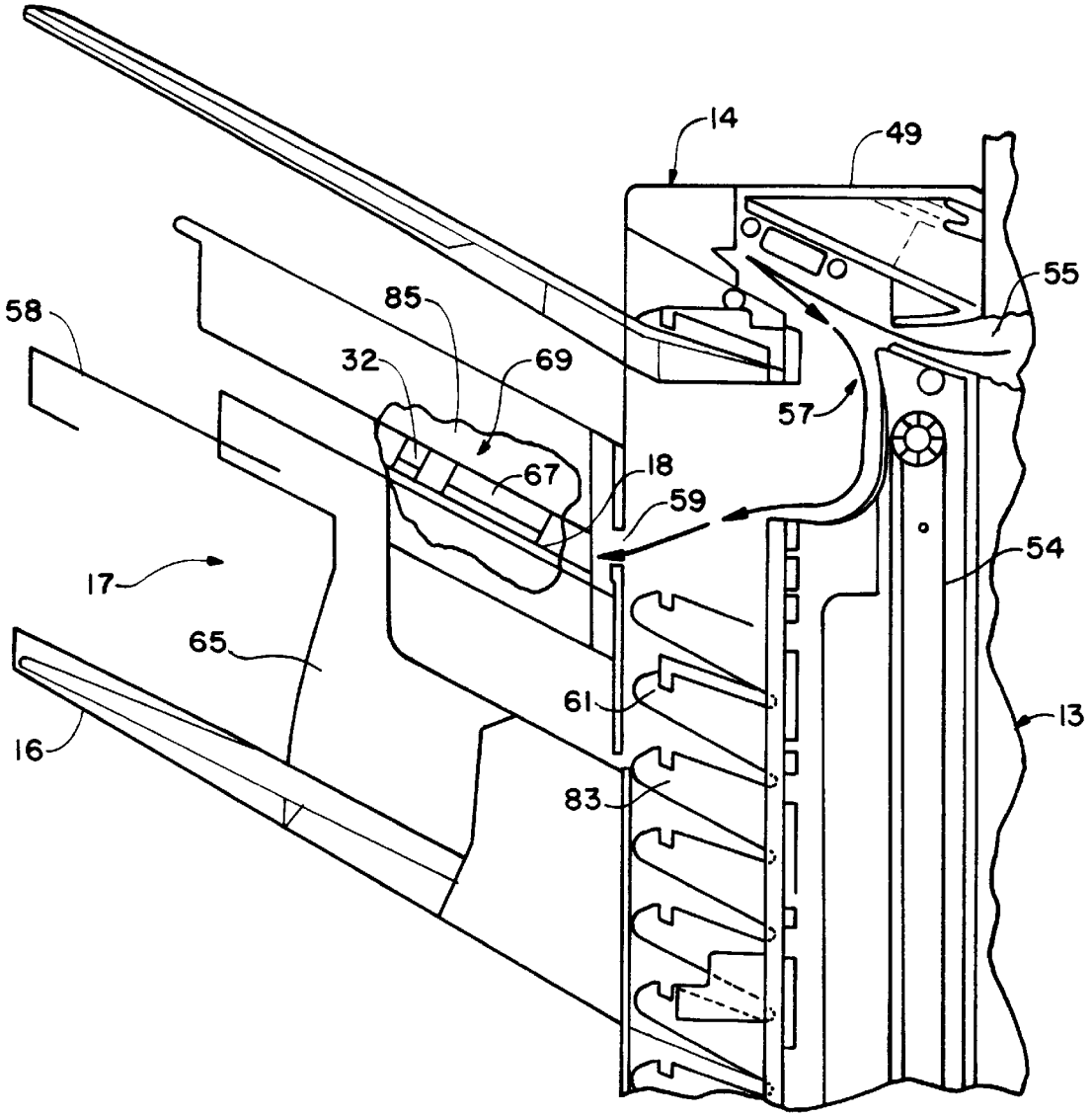
FIG. 2B is an enlarged fragmentary view of the finishing module and upper portion of the receiver illustrating the paper path therewithin.

Considering now the receiver 14 in greater detail with reference to FIGS. 2, 2A and 2B, the receiver 14 includes a housing 49 movably supported on the lower by a set of casters, such as the caster 53. A transport conveyor belt is vertically mounted to help move the paper sheets into the finishing module 17 or alternatively to the stacking trays 15. The paper enters the housing 49 at 55 and moves generally along a paper path generally indicated at 57. In this regard, it generally moves horizontally until it reverses its direction and backs downwardly into an opening 59 in a housing 58 of the module 17.

In order to removably mount the module 17 on the receiver 14, a series of vertically spaced apart pairs of support arms generally indicated at 63 receive and support the module 17 there between. Similarly, the pairs of support arms 63 support the paper stacking trays 15 in a similar manner. Thus, in accordance with the present invention, the module 17 can be readily removed from the receiver 14, and replaced with stacking trays. Thus, the printing system 10 is highly flexible. Should the user desire to have additional stacking trays, the module 17 is thus removed from the receiver 14. Alternatively, if the user desires not to have a finishing module and be able to have additional stacking trays, the system 10 can accommodate such use.

Considering the now finishing module 17 in greater detail with reference to FIGS. 1, 2, 2B, 3 and 4, the module 17 includes a housing 65 having the inlet opening 59 (FIG. 2B) to provide an inlet for the printed paper to be delivered thereto by the transport belt 54.

As best seen in FIG. 2B, the printed paper sheets entering the module housing 65 are deposited onto the upper surface of a platform or bed 18. The paper is then guided to a resting position with its side marginal edges adjacent to a stapler 32 which is disposed at the right side of the housing 65. A hole forming punch 67 is disposed adjacent to the stapler 32 to facilitate the forming of holes in one or more paper sheets. When a predetermined quantity of printed paper sheets are deposited onto the bed 18, the stapler 32 then affixes the corner portion of the paper sheets to form a document.

The stapler 32 and the hole forming punch 67 comprise a finishing mechanism generally indicated at 69 to continuously finish paper sheets exiting the printer 13 and moving along the paper feed path 57 and into the finishing module 17.

Figure 3:
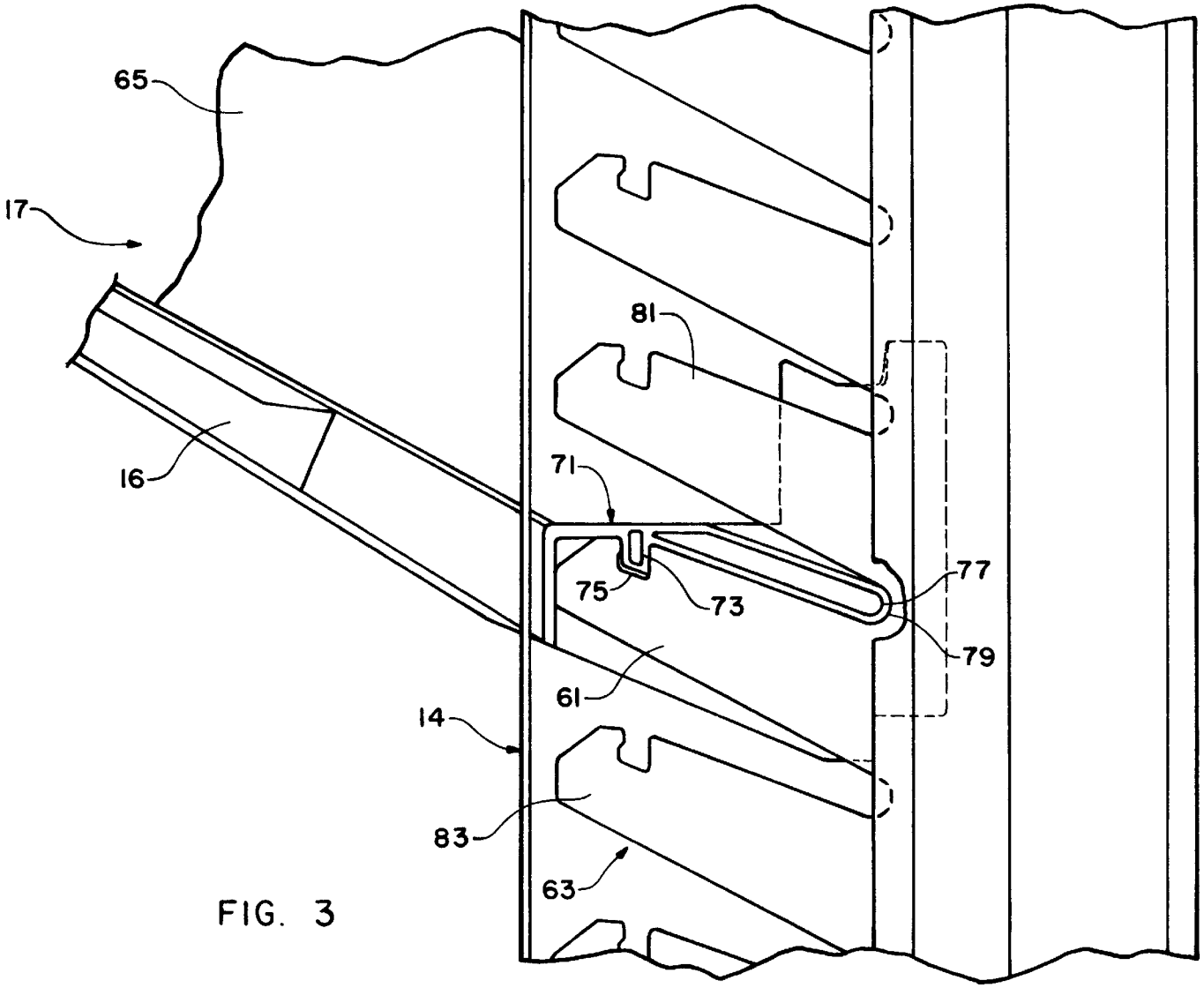
FIG. 3 is an enlarged detail left side elevational view, illustrating the manner of attaching the finishing module to the receiver.

In order to support the module 17 by the support arms 63, as best seen in FIG. 3, the left support arm 61 supports the left side of the module housing 65 by means of a generally L-shaped projection extending from the left side of the housing 65 to rest generally on the top surface of the support arm 61. A similar projection (not shown) on the right side of the housing 65 rests on top of a corresponding arm (not shown) at a similar elevation to support the housing there between.

The L-shaped projection 71 includes a depending leg portion 73 which fits into an upwardly facing notch 75 in the upper edge of the arm 61 to help seat the projection 71 in place on the arm 61. Also, a rounded rear end portion 77 fits into a complementary-shaped rounded opening 79 between the lower arm 61 and a similar-spaced apart upper arm 81 to help seat the projection 71 in place between the two arms 61 and 81.

Figure 4:
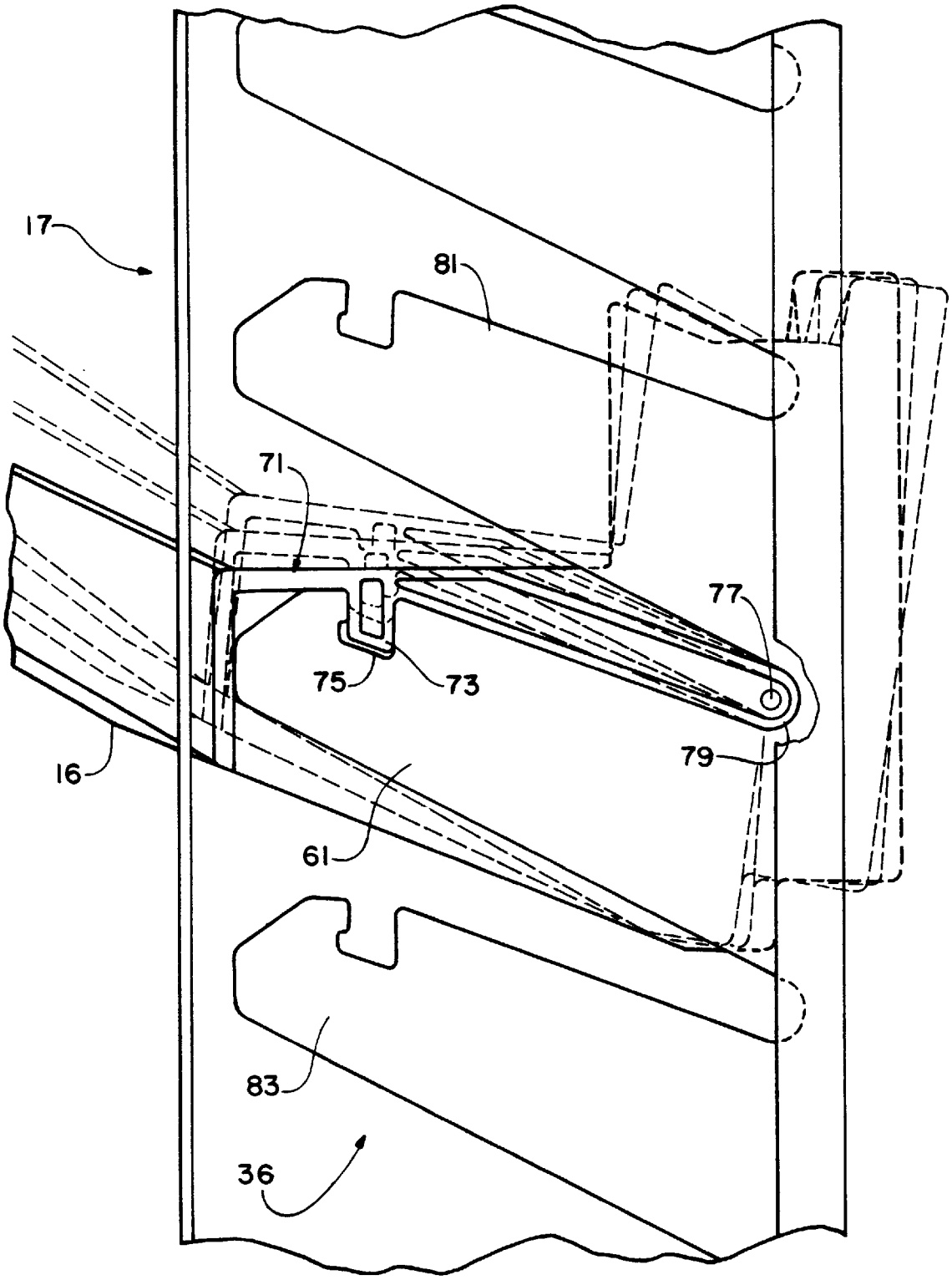
FIG. 4 is a view similar to the view of FIG. 3, illustrating the finishing module in the process of being separated from the receiver.

In order to remove the module 17 from the receiver 14, the housing 65 is grasped by the hands of the user and pivoted upwardly about the rounded rear end portion 77 of the projection 71 as indicated in FIG. 4 to withdraw the leg 73 from the notch 75. Thereafter, the module 17 can be lifted out of supporting relationship between the left arm 61 and its corresponding right arm (not shown).

In order to adjust the height of the module 17 for the purpose of both enabling the module 17 and the receiver 14 to accommodate various different printers, the module 17 could be positioned with the projection 71 resting on the next lower pair of arms such as the support arm 83 (FIG. 3) to effectively lower the height of the module 17. In this regard, each one of the pairs of horizontally spaced-apart support arms define a serious of vertically spaced-apart receiving locations. The inlet or access opening 59 to the module housing 65 is aligned with one of the receiving locations once the housing 65 is secured in place by a pair of support arms. When the module 17 is removed from the receiver 14, stacking trays can be mounted in a similar manner to the vacated support arms, such as the support arm 61 to align the stacking tray with one of the receiving locations to enable the stacking tray to receive the printed paper sheets in place of the finishing module 17.

As best seen in FIG. 2B, the finishing mechanism 69 completes the finishing operation at a finishing station 85 disposed within the housing 65 and is then ejected therefrom and dropped into a lower stacking tray 16. The stacking tray 16 forms a part of the module 17 and receives and supports in a stack the finished paper sheets.

Figure 5:
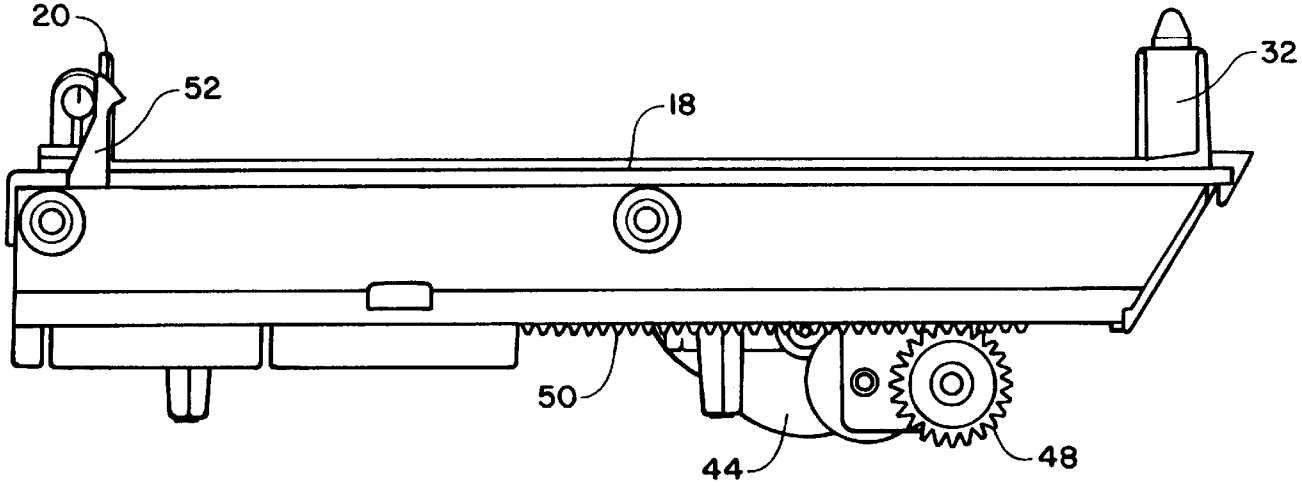
FIG. 5 is an enlarged right side elevational view of the platform for receiving the paper sheets to be finished, the hole punch being omitted for sake of clarity.
Figure 6:
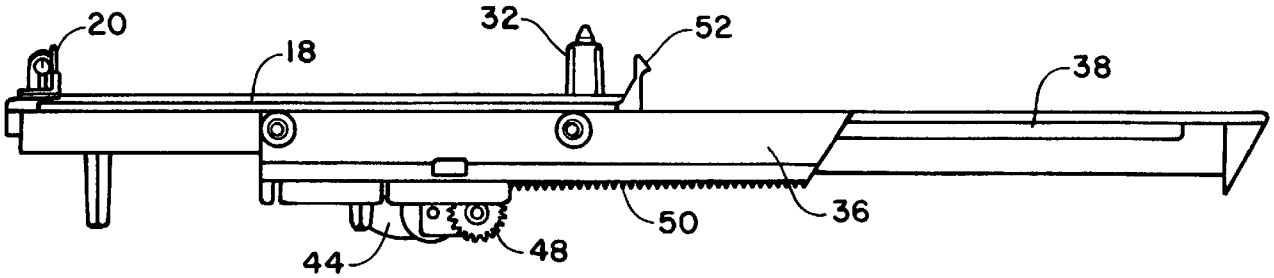
FIG. 6 is a view similar to the view of FIG. 5, illustrating the telescoping discharge device for enabling the finished paper sheets to be discharged therefrom.
Figure 7:
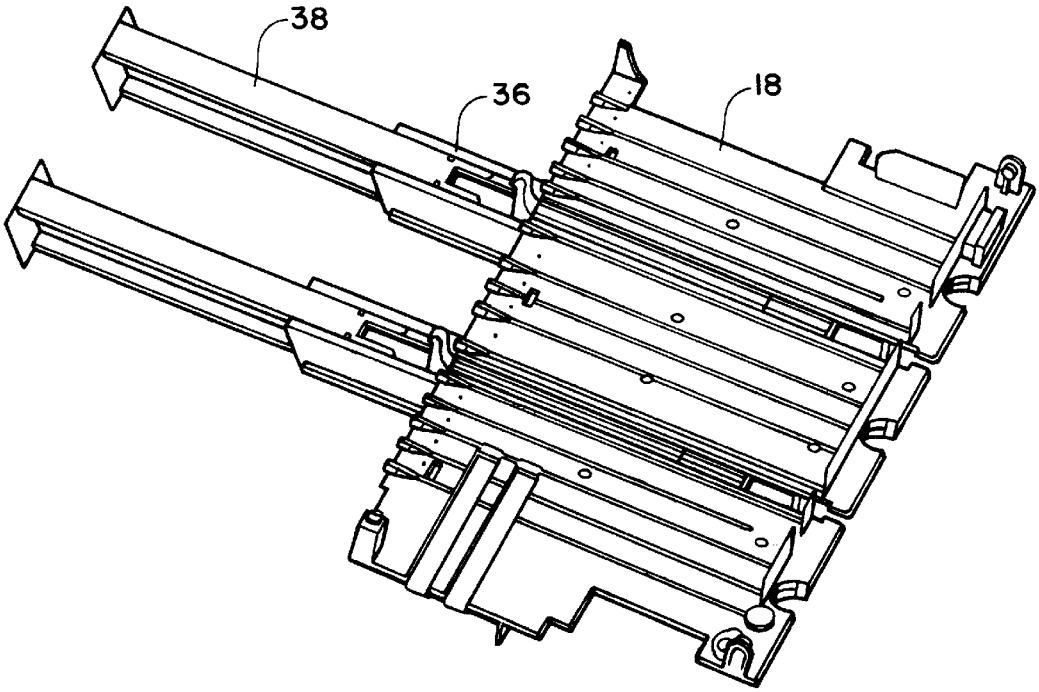
FIG. 7 is a pictorial view of the platform or bed showing the discharge arms in their protracted positions, similar to the view of FIG. 6.

Considering now the manner in which the finished paper sheets are ejected from the finishing station 85 and into the lower stacking tray 16 with reference to FIG. 5, 6 and 7 of the drawings, a discharging mechanism includes a pair of retractable telescoping arms, such as a pair of right telescoping outer and inner arms 36 and 38. Considering now only the right telescoping arms 36 and 38, an upstanding dog 52 at the rear marginal edges of the paper sheets resting on top of the bed 18 are moved forwardly by the dog 52, which in turn is carried by the inner telescoping member or arm 38 as it moves extensively relative to the support bed 18 as indicated in FIG. 6. As shown in FIG. 6, the inner arm 38 moves to a cantilevered position to cause the dog 52 to move the sheets beyond the bed 18 and away from the stapler 32. In the protracted position as shown in FIG. 6, the outer telescoping member or arm 36 has moved to the protracted position to a lesser extent than the number 38 to help support the inner arm 38. In this position, the paper sheets rest on top of the telescoping arms and are supported from below by the arms in the position as indicated in FIG. 6. Thereafter, the arms retract quickly to permit the paper sheets to all under the force of gravity and into the lower stacking tray 16.

For the purpose of driving the telescoping arms, such as the arms 36 and 38, extensively from the position as indicated in FIG. 5 to the position as indicated in FIG. 6, a motor 44 drives a pinion 48, which in turn drives a rack 50 integrally formed on the underside of the inner arm 38. For a more detailed description of the ejection mechanism of the module 17, reference may be made to the above-mentioned co-pending German patent application 19629158.5.

Figure 8A:
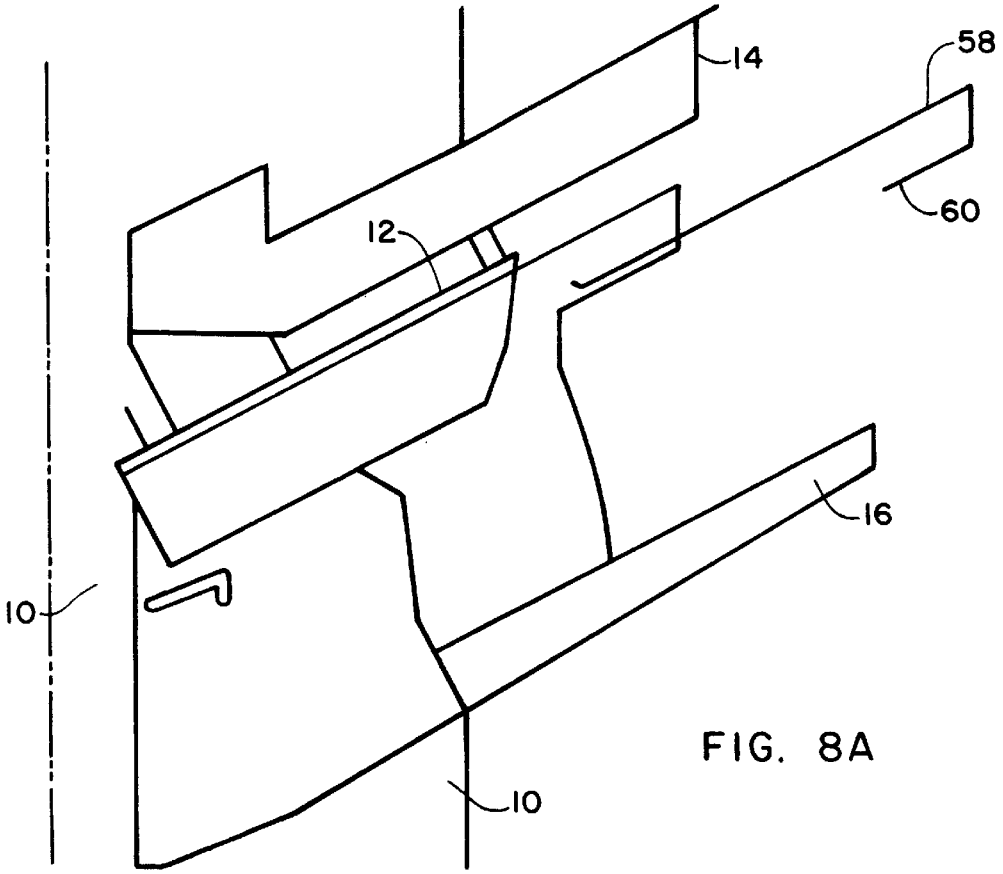
FIGS. 8A–8E are diagrammatic views of the finishing module to show progressively the discharging of a finished paper sheet therefrom.
Figure 8B:
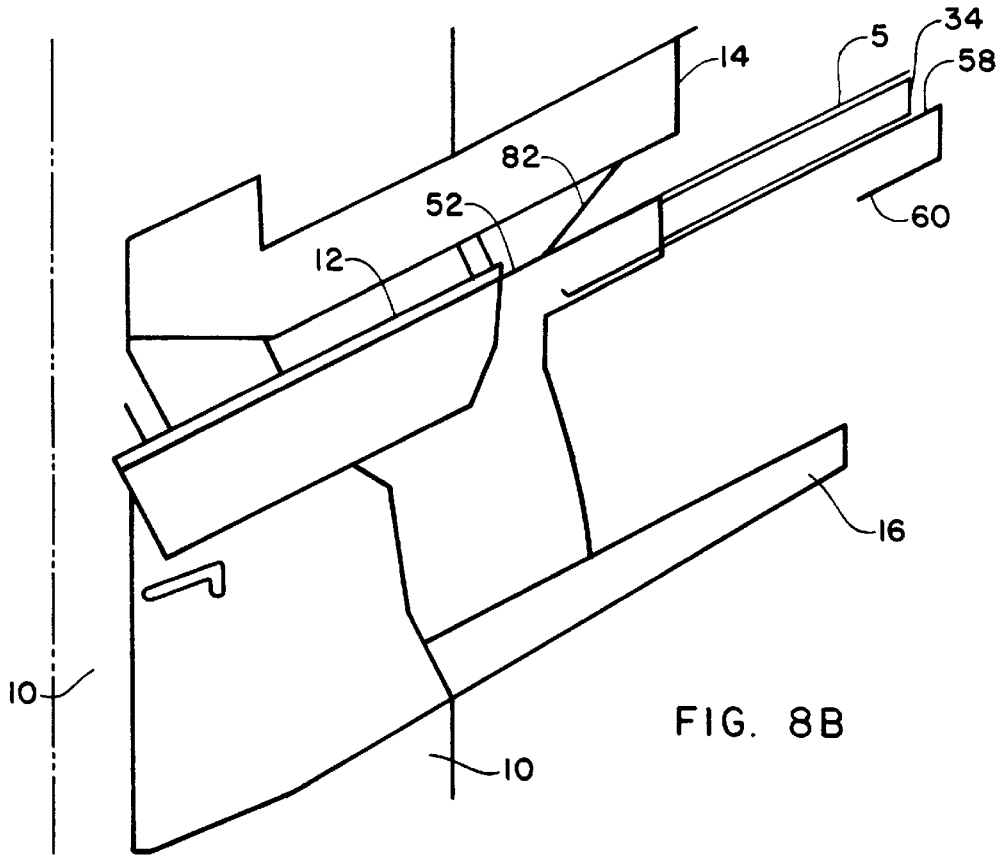

Considering now the manner in which the paper sheets drop into the lower stacking tray 16, with reference to FIGS. 8A through 8E, there is shown the manner in which a paper sheet 5 is ejected into the lower paper tray 16. As shown in FIG. 8A, a guide rod 58 as a reversely bent distal end portion 60 to help guide the falling paper sheets into the lower paper tray 16. As indicated in FIG. 8B, the telescoping arms, such as the inner arm 34, carries the paper sheet 5 outwardly parallel and above the guide rod 58.

Figure 8C:
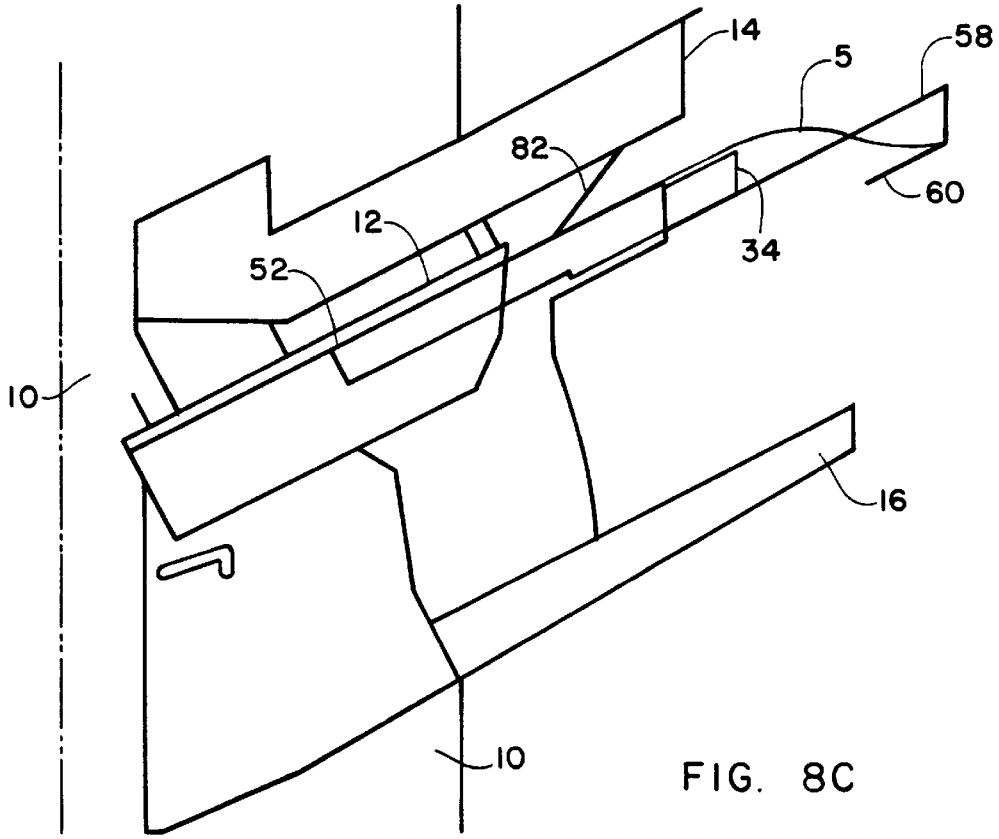
Figure 8D:
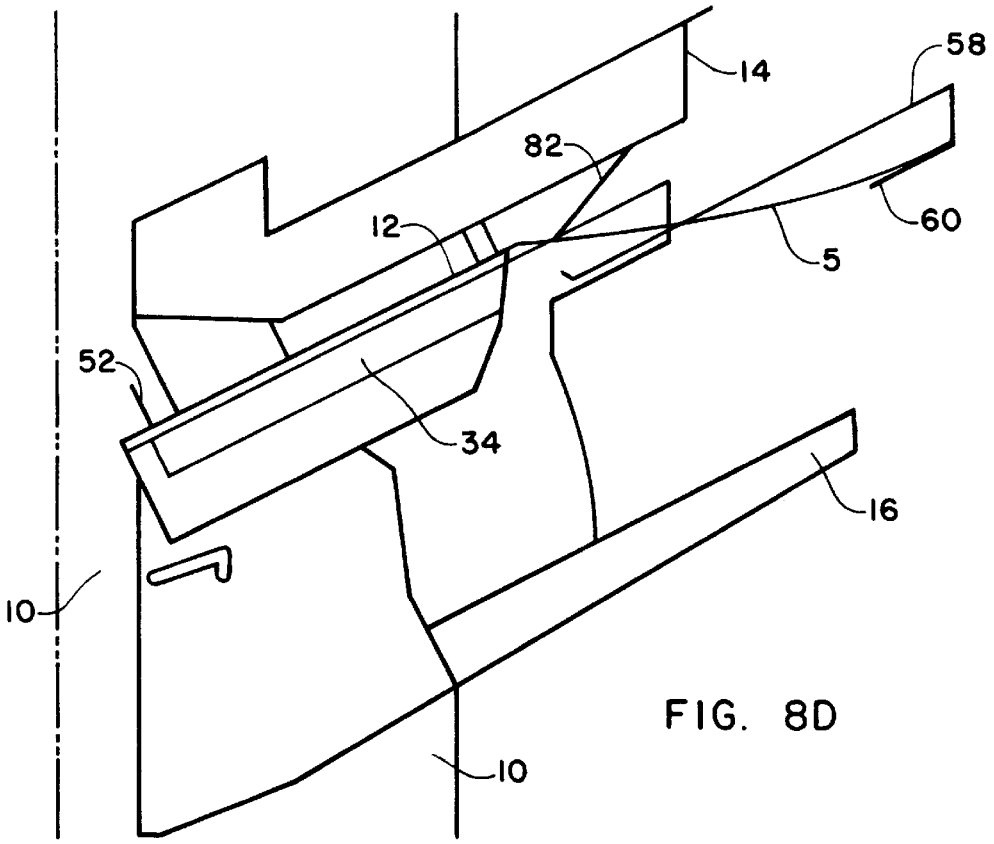
Figure 8E:
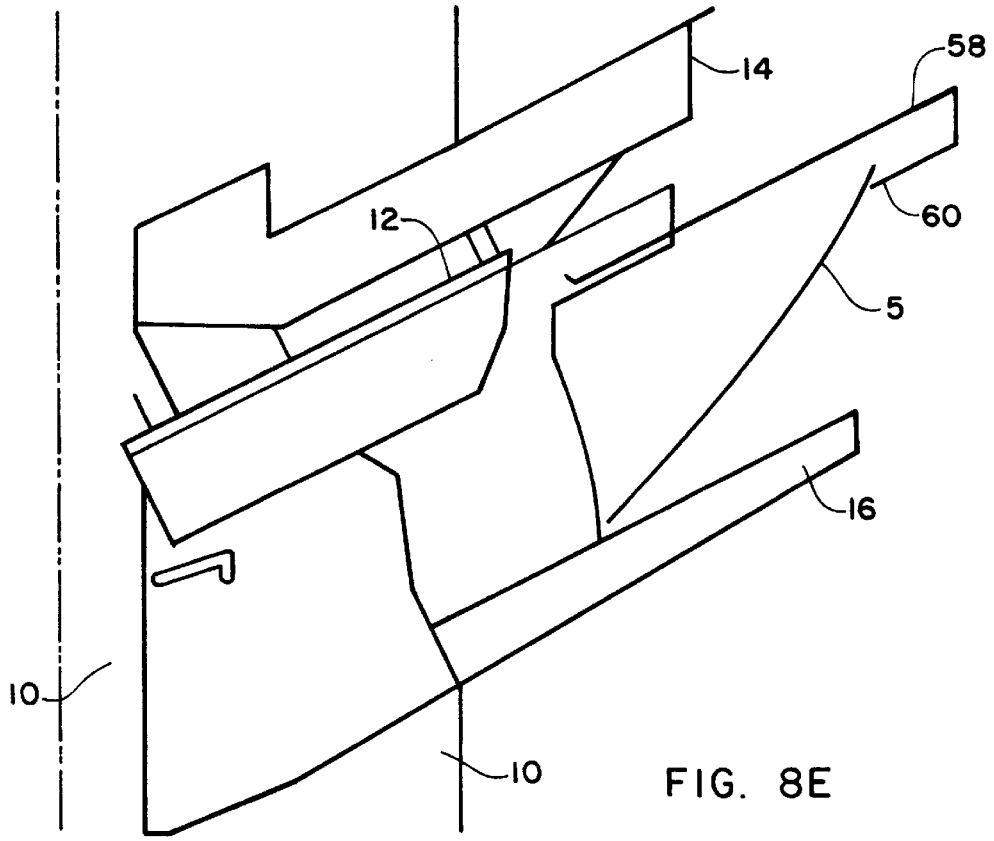

As indicated in FIG. 8C, the inner telescoping arm or member 34 retracts quickly backwardly to withdraw the support for the paper sheet 5, which then drops downwardly into engagement with the reversely bent portion of the guide rod 58 to cause the forward marginal end portion to be received by the guide rod 58. Thereafter, as shown in FIG. 8D, the inner and outer telescoping members are fully retracted to cause the paper sheet 5 to extend momentarily between the bed 18 and the reversely bent portion of the guide rod 58. The paper 5 then falls away from the bed 18 so that the rear end portion of the paper sheet 5 falls toward the lower stacking tray 16. The front end portion of the paper sheet 5 then falls as the distal end portion 60 of the guide rod 58 as indicated in FIG. 8E. Thus, the paper sheets are guided in their fall into a proper stacking position on the lower stacking tray 16.

Figure 9:
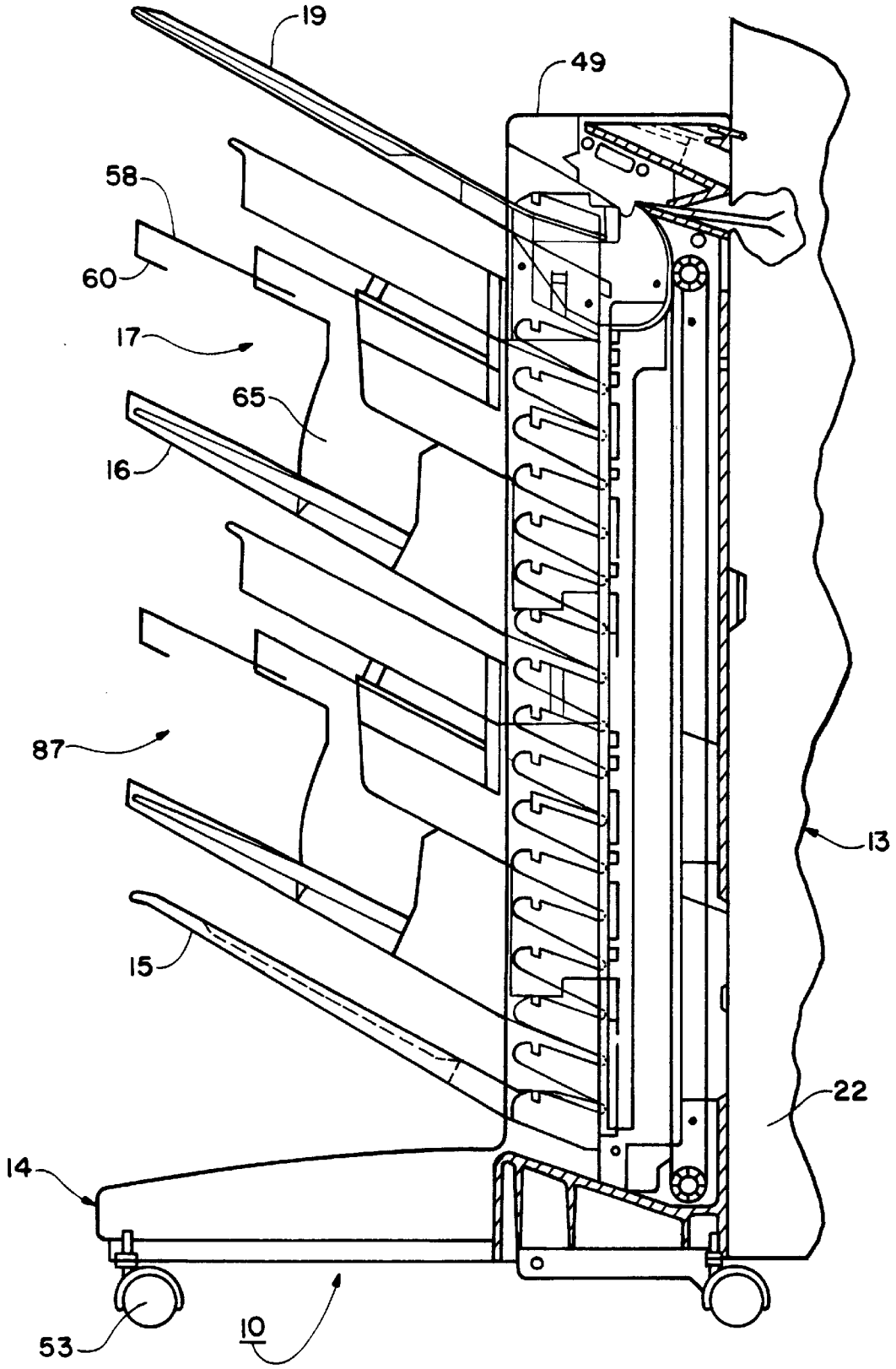
FIG. 9 is a view of the printing system of FIG. 2, illustrating it with an additional finishing module being disposed thereon.
Figure 10:
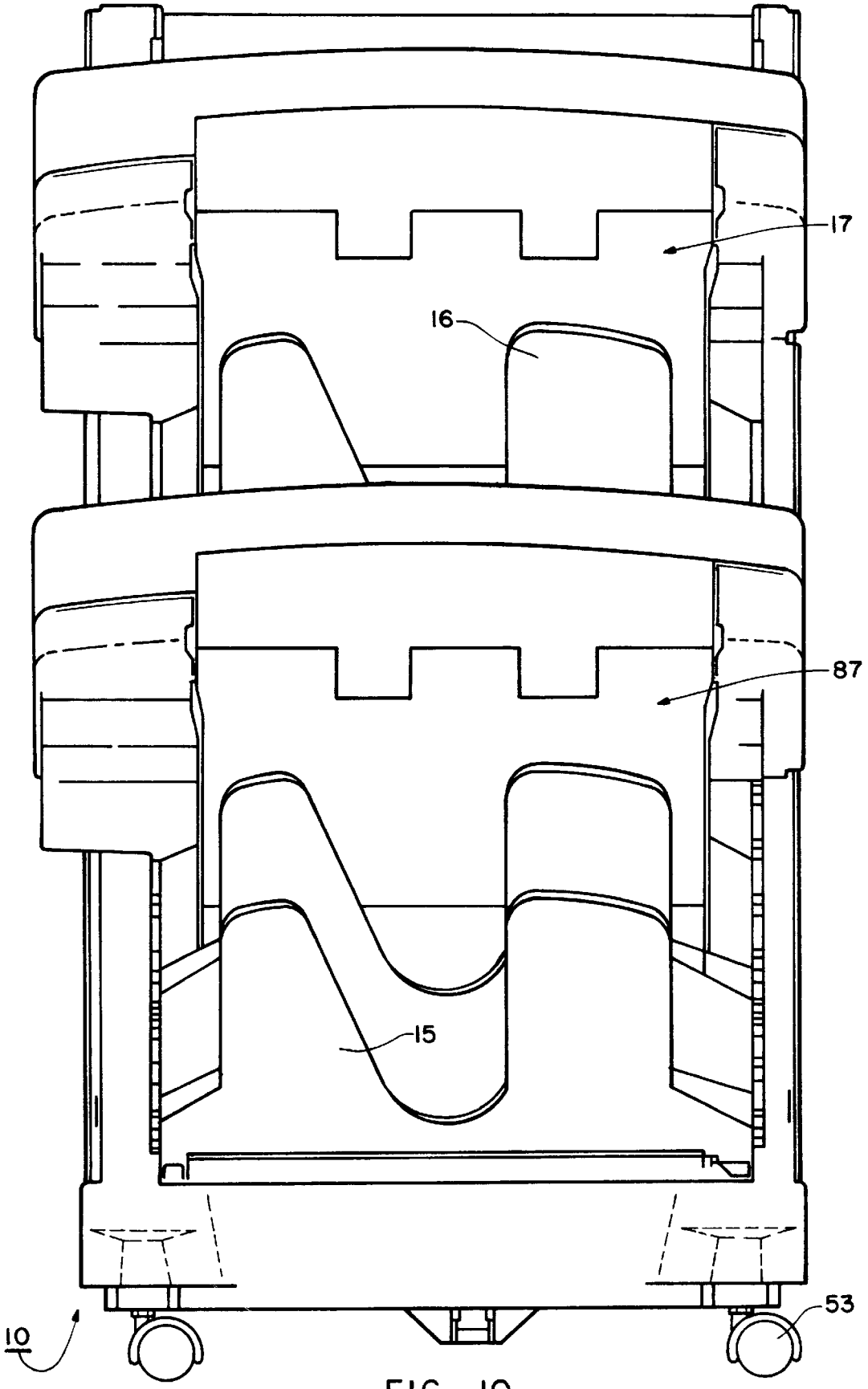
FIG. 10 is a front elevational view of the printing system of FIG. 9.

As shown in FIG. 9, additional stacking trays of the group of stacking trays 15 (FIG. 2) have been removed and replaced with a second finishing module 87 mounted below the upper finishing module 17. The module 87 is generally similar to the module 17 and enables a greater capacity of finishing to be accomplished by the system 10.

Figure 11:
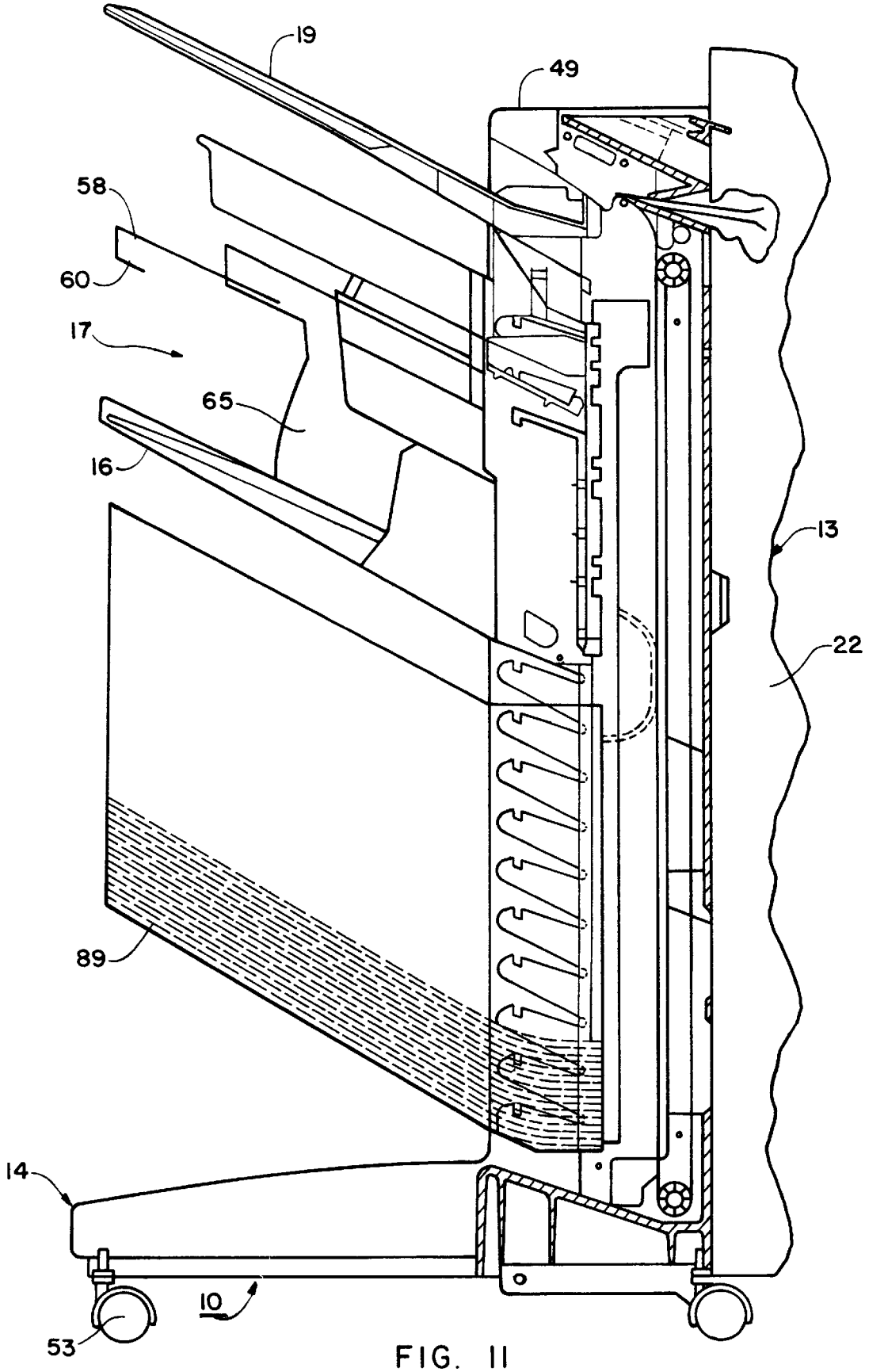
FIG. 11 is a side elevational view of the printing system of FIG. 2, illustrating the stacking trays being removed and replaced with a high capacity tray.
Figure 12:
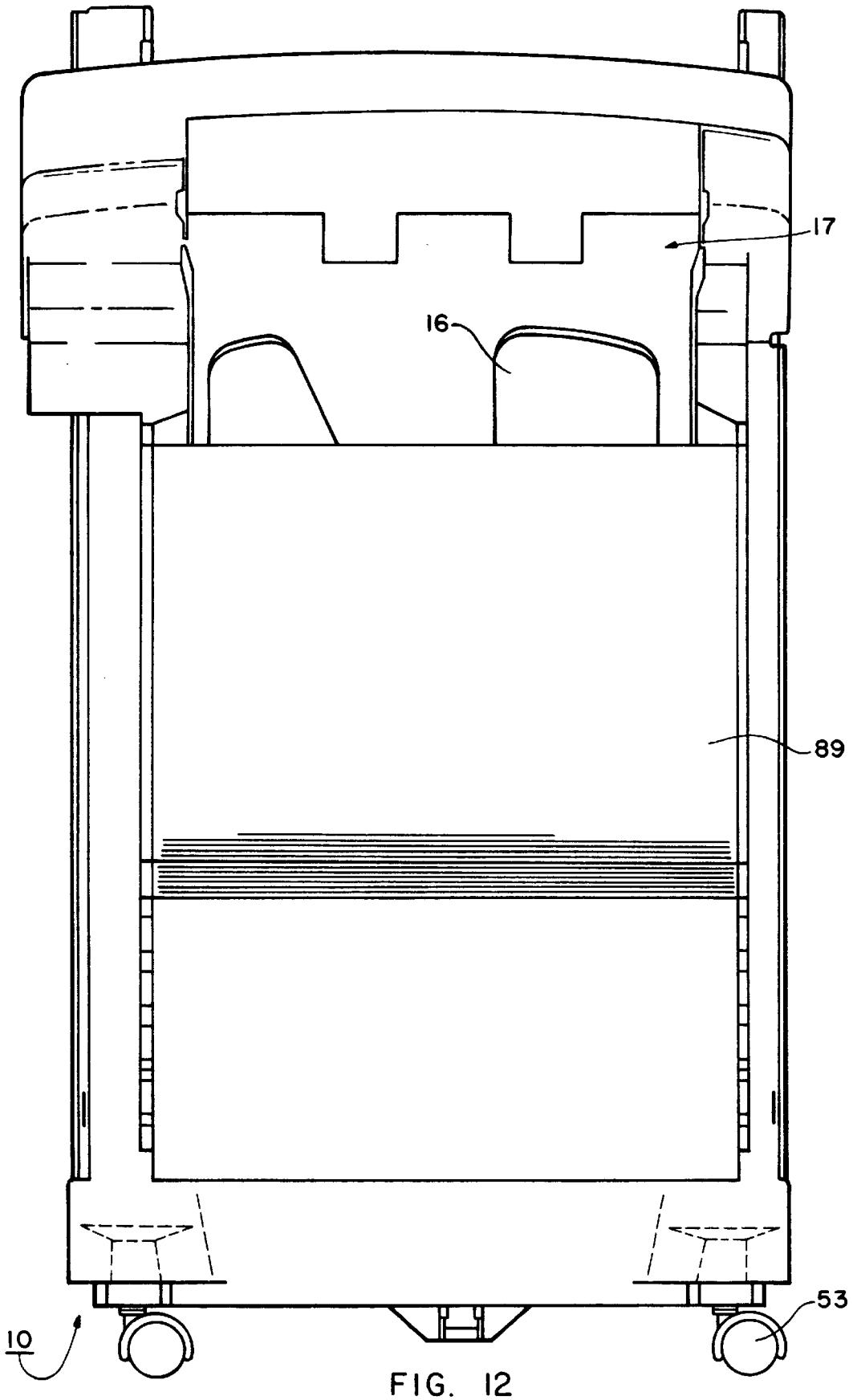
FIG. 12 is a front elevational view of the printing system of FIG. 11.

Referring to FIG. 11, there is shown the system 10 with the stacking trays 15 removed and replaced with a high capacity stacking bin 89 mounted in place thereof below the finishing module 17. In this mode of operation, paper sheets can be finished by the module 17 and other paper sheets can be delivered to the high capacity storage bin 89.

Figure 13:
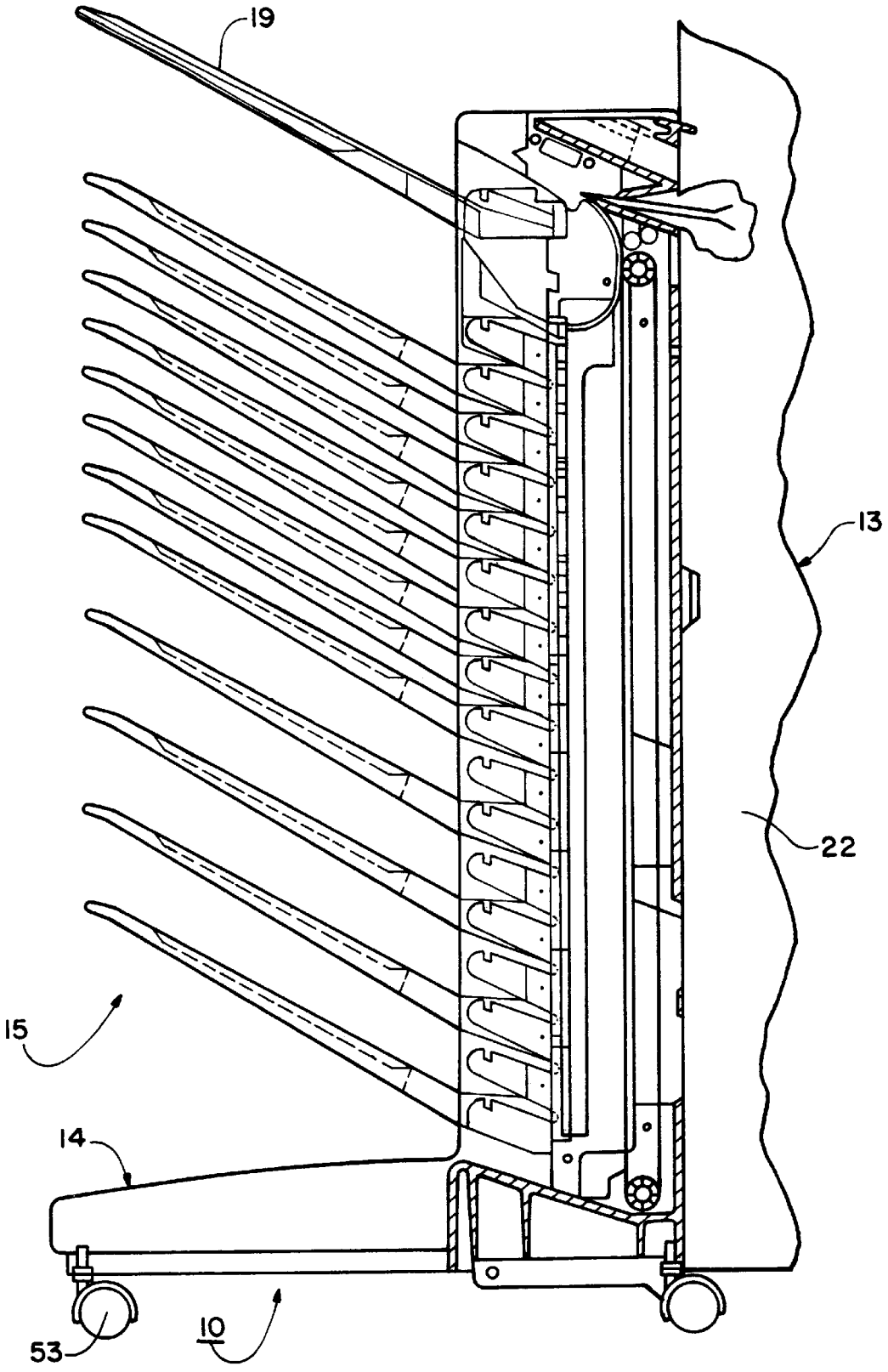
FIG. 13 is a side elevational view of the printing system of FIG. 2, illustrating the receiver with the finishing module removed therefrom and replaced with a set of stacking trays.

Referring now to FIG. 13, there is shown the system 10 with all of the stacking trays 15 mounted to the receiver 14, with the finishing modules 17 and 87 and the high capacity stacking bin 89 removed. Thus, the system 10 is highly flexible in its various different modes of operation to provide a flexible mode of operation for the user.

Appendix A is co-pending German patent application 19625994.0. Appendix B is co-pending German patent application 19629158.5.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An output paper sheet finishing module for printed paper sheets received from a non-impact printer having a paper sheet receiver, said receiver having a plurality of stacking trays at a series of receiving locations, said module comprising:

a housing for receiving printed paper sheets seriatim therewithin to be finished, the housing having an inlet for receiving paper sheets to be finished from the printer;

means disposed within said housing for finishing the printed documents entering said receiver from the printer;

means for discharging the finished paper sheets from said housing;

means on said housing for helping to mount removably said housing to the receiver with said inlet being disposed at one of said receiving locations to enable said module to be detached and removed from the receiver; and means on the receiver for helping to support at least one stacking tray and for alternatively helping to support said housing to enable the module to be removed from the receiver and to be replaced with at least one stacking tray.

2. An output paper sheet finishing module according to claim 1, wherein said finishing means includes a stapler for affixing paper sheets together to form the documents.

3. An output paper sheet finishing module according to claim 1, wherein said finishing means includes a hole forming means for forming holes in the printed paper sheets.

4. An output paper sheet finishing module according to claim 1, wherein said means for discharging includes retractable means for supporting from below at a finishing station the printed paper sheets one at a time as the sheets enter the module housing.

5. An output paper sheet finishing module according to claim 4, wherein said retractable means for moving quickly out from under the paper sheets supported thereon to permit them to fall under the force of gravity to a storage location.

6. An output paper sheet finishing module according to claim 5, wherein said discharging includes a guide for facilitating the stacking of the finished paper sheets falling from the finishing station.

7. An output paper sheet finishing module according to claim 6, wherein said guide includes a rod disposed in the path of travel of the falling documents to engage one end portion thereof to interrupt the fall and to thereby direct the paper sheets into a stack of like finished sheets.

8. An output paper sheet finishing module according to claim 1, wherein said means on said housing includes a pair of L-shaped projections disposed on opposite sides of the housing.

9. An output paper sheet finishing module according to claim 8, wherein said means on the receiver includes a pair of arms for receiving and supporting the housing therebetween, said arms each including means defining notches therein for receiving the projections therewithin.

10. An output paper sheet finishing module according to claim 1, further including height adjustment means for enabling the module to be mounted to said receiver at a desired height relative to said printer.

11. A method of finishing printed paper sheets received from a non-impact printer used with a paper sheet receiver having a plurality of paper sheet stacking trays, comprising:

receiving printed paper sheets seriatim therewithin to be finished, a housing having an inlet for receiving paper sheets to be finished from the printer;

finishing the printed paper sheets entering said receiver from the printer;

discharging the finished paper sheets from said housing;

helping to mount removably said housing to the receiver with said inlet being disposed at one of said receiving locations to enable said module to be detached and removed from the receiver; and helping to support at least one stacking tray and for alternatively helping to support said housing to enable the module to be removed from the receiver and to be replaced with at least one stacking tray.

12. A method according to claim 11, further including affixing paper sheets together to form the documents.

13. A method according to claim 10, further including forming holes in the printed paper sheets.

14. A method according to claim 11, further including supporting from below at a finishing station the printed paper sheets one at a time as the paper sheets enter the module housing.

15. A method according to claim 14, further including moving quickly out from under the paper sheets supported thereon to permit them to fall under the force of gravity to a storage location.

16. A method according to claim 15, further including facilitating the stacking of the finished paper sheets falling from the finishing station.

17. A method according to claim 16, further including guide means disposed in the path of travel of the falling paper sheets to engage one end portion thereof to interrupt the fall and to thereby direct the paper sheets into a stack of like finished paper sheets.

18. An output paper sheet printing system, comprising:

a non-impact printer;

a paper sheet receiver being adapted to be mounted to the printer and having a plurality of stacking trays at a series of receiving locations for receiving printed documents from the printer;

a module including a housing for receiving printed paper sheets seriatim therewithin to be finished, a housing having an inlet for receiving paper sheets to be finished from the printer;

means disposed within said housing for finishing the printed paper sheets entering said receiver from the printer;

means for discharging the finished paper sheets from said housing;

means on said housing for helping to mount removably said housing to the receiver with said inlet being disposed at one of said receiving locations to enable said module to be detached and removed from the receiver; and means on the receiver for helping to support at least one stacking tray and for alternatively helping to support said housing to enable the module to be removed from the receiver and to be replaced with at least one stacking tray.

19. A system according to claim 18, further including a non-impact printer for supplying the printed documents to said inlet of said housing.

20. A system according to claim 19, further including another like module disposed removably at another receiving location.

21. A system according to claim 19, further including a high capacity receiving bin removably mounted to the receiver at one of said receiving locations.

* * * * *